US006378430B1

(12) United States Patent
Eighmy et al.

(10) Patent No.: US 6,378,430 B1
(45) Date of Patent: Apr. 30, 2002

(54) CYLINDER WITH PLATE GRIPPING DEVICE

(75) Inventors: Clifford R. Eighmy, Joplin; Johnnie Dee Buchanan, Neosho, both of MO (US)

(73) Assignee: King Press Corporation, Joplin, MO (US)

( * ) Notice: Subject to any disclaimer, the term of this patent is extended or adjusted under 35 U.S.C. 154(b) by 0 days.

(21) Appl. No.: 09/572,154

(22) Filed: May 17, 2000

Related U.S. Application Data

(60) Provisional application No. 60/159,700, filed on Oct. 15, 1999.

(51) Int. Cl.[7] ..... B41F 1/28
(52) U.S. Cl. ..... 101/415.1; 101/378; 101/383
(58) Field of Search ..... 101/415.1, 378, 101/375, 382.1, 383

(56) References Cited

U.S. PATENT DOCUMENTS

| | | | | |
|---|---|---|---|---|
| 3,659,525 A | | 5/1972 | Woessner et al. | |
| 4,104,968 A | | 8/1978 | Schwaab et al. | |
| 4,133,264 A | | 1/1979 | Fermi et al. | |
| 4,495,865 A | | 1/1985 | Kamoda | |
| 4,502,388 A | * | 3/1985 | Ishii | 101/415.1 |
| 4,840,121 A | * | 6/1989 | Szczesniak | 101/415.1 |
| 5,010,818 A | | 4/1991 | Wallschlaeger, Sr. | |
| 5,062,363 A | | 11/1991 | Reichel | |
| 5,123,353 A | | 6/1992 | Beck | |
| 5,483,891 A | | 1/1996 | Reichel | |
| 5,484,783 A | | 1/1996 | Rau et al. | |
| 5,644,984 A | | 7/1997 | Puschnerat et al. | |
| 5,653,170 A | | 8/1997 | Puschnerat et al. | |
| 5,749,298 A | * | 5/1998 | Castelli et al. | 101/415.1 |
| 6,026,746 A | * | 2/2000 | Andaloro | 101/415.1 |

* cited by examiner

*Primary Examiner*—John S. Hilten
*Assistant Examiner*—Kevin D. Williams
(74) *Attorney, Agent, or Firm*—Chase Law Firm, L.C.

(57) ABSTRACT

A flexible plate is gripped and secured to a plate cylinder in a rotary printing press by spaced-apart tines extending from an operating shaft rotatably mounted within a bore in the cylinder. The leading and trailing legs of the flexible plate are inserted in a channel in the cylinder, and then rotation of the shaft to a plate-securing position causes the tines to penetrate the trailing leg and hold the plate.

17 Claims, 2 Drawing Sheets

CYLINDER WITH PLATE GRIPPING DEVICE

This application claims the benefit under 35 U.S.C. § 119 (e) of Provisional Application No. 60/159,700 filed Oct. 15, 1999.

BACKGROUND OF THE INVENTION

This invention relates generally to a cylinder provided with a plate gripping and securing device and, in particular, to a plate cylinder for a rotary printing press that utilizes spaced-apart tines to penetrate a trailing leg of the plate to secure the plate to the outer surface of the cylinder.

Various devices for securing flexible plates to cylinders in rotary printing presses are generally known. Typically, the leading and trailing legs of the printing plate are inserted into a narrow, axially extending slot in the surface of the cylinder. The plate legs are held in place by a clamping device that is situated in the interior of the cylinder. For example, as disclosed in U.S. Pat. No. 5,653,170, the clamping device may comprise a rotatable spindle or shaft with radially outwardly extending, spring-biased pressure elements that force the plate legs against a lateral wall of the slot. The pressure applied by the pressure elements holds the plate in place.

A general limitation of this type of prior art device is that the pressure applied to the plate legs by the pressure elements may be overcome allowing the plate to slip on the cylinder. This limitation is particularly pertinent to flexible plates made of polyester or other plastic material, because these materials are inherently slick and not easily held in place by a clamping or pressure force.

SUMMARY OF THE INVENTION

It is therefore the primary object of the present invention to provide an apparatus which positively secures a flexible plate to a cylinder.

Another important object of the present invention is to provide an apparatus capable of positively gripping the legs of a flexible plate of plastic or other slick material to secure the plate to a cylinder.

Still another important object of the present invention is to provide such an apparatus which prevents a flexible plate secured to a cylinder from slipping.

Yet another important object of the present invention is to provide such an apparatus for securing a flexible plate on a cylinder which is simple to operate.

A further important object of the present invention is to provide an apparatus which positively secures a plastic plate on a plate cylinder of a rotary printing press.

These and other objects of the present invention are generally achieved by providing a plate cylinder with a narrow slot for receiving the leading and trailing legs of a printing plate, the slot defining a channel that extends in parallelism with the axis of the cylinder. A bore in the cylinder also extends axially thereof and is tangentially in communication with the channel. An operating shaft that carries spaced-apart, axially aligned, radially-extending gripping tines is positioned in the bore and is rotatable between a plate-securing position and a plate-releasing position. When the legs of a flexible plate have been inserted into the channel, the shaft is rotated to the plate-securing position, where the gripping tines contact the surface of the plate's trailing leg and then penetrate through the trailing leg as the shaft is completely rotated to the plate-securing position. When the shaft is rotated to the plate-releasing position, the tines push the plate's trailing leg from the channel to release the plate from the cylinder.

DETAILED DESCRIPTION

Figure 1:
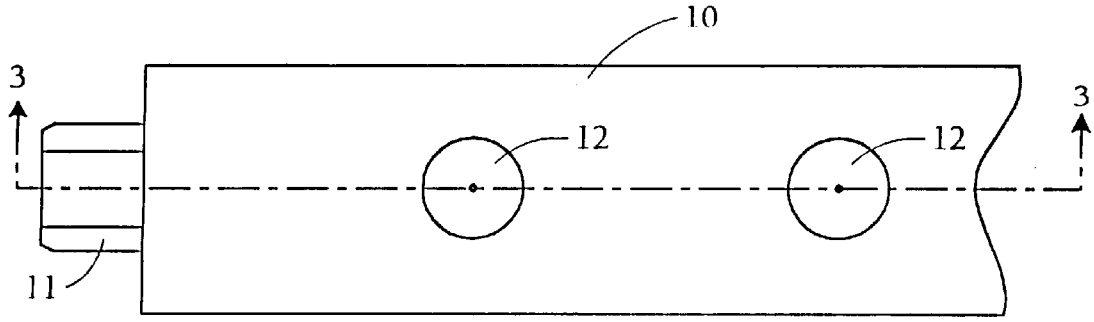
FIG. 1 is a fragmentary plan view of the plate operating shaft and tines.
Figure 2:
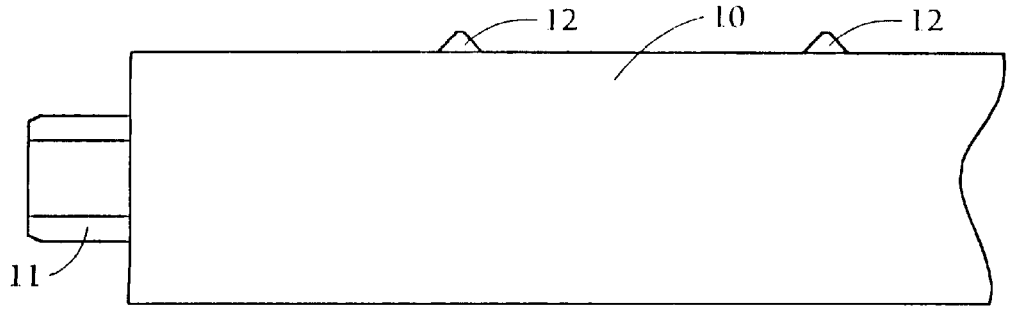
FIG. 2 is an elevation view of FIG. 1.
Figure 3:
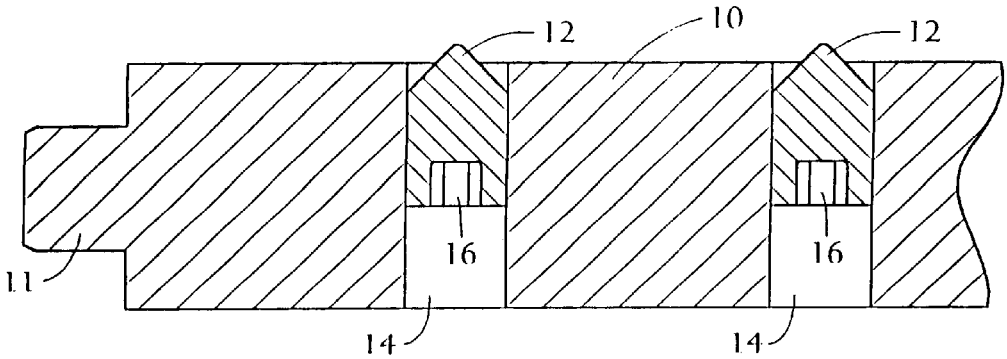
FIG. 3 is a cross-sectional view taken alone line 3—3 of FIG. 1.

FIGS. 1–3 illustrate an example of a generally cylindrical operating shaft 10 which has adjusting head 11 and tines 12 extending radially outwardly from the surface of the shaft. Tines 12 are spaced along the length of shaft 10 generally in an axial alignment and parallel to one another. Tines 12 may be made from set screws and thus are externally threaded and adjustably inserted in respective threaded bores 14 extending radially through shaft 10. Tines 12 may be secured in place with a nyloc insert to bind the threads (not shown) or other locking means to prevent tines 12 from moving from their installed and adjusted position.

Figure 4:
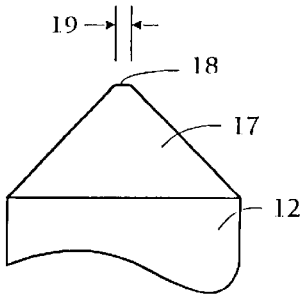
FIG. 4 is an enlarged view of the tip of a tine shown in FIG. 2.

Referring to FIG. 4, the nose 17 of each tine 12 is generally conically shaped with a flat tip 18. Tip 18 is generally circularly or elliptically shaped when viewed axially or perpendicular to the surface of tip 18. The diameter 19 of tip 18 is preferably 0.030 inch but may vary depending on the material of the plate to be gripped.

Figure 5:
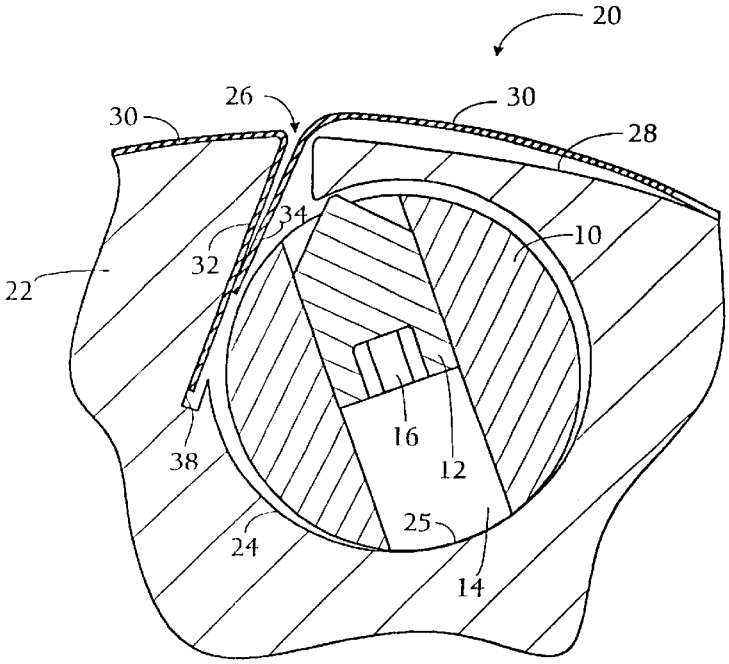
FIG. 5 is a transverse cross-sectional view of a portion of a cylinder in a rotary offset printing press, showing the operating shaft and a tine in the plate-releasing position.
Figure 6:
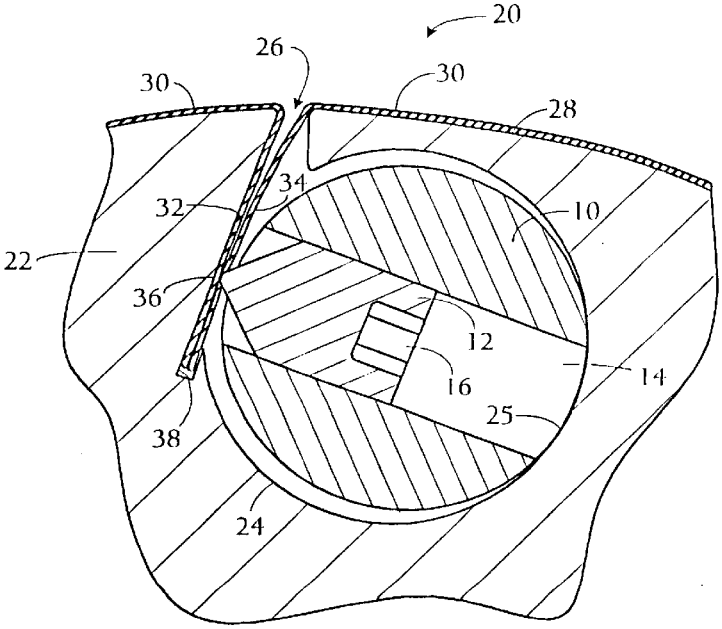
FIG. 6 is a view similar to FIG. 5 showing the operating shaft rotated to the plate-securing position.

Referring to FIGS. 5 and 6, a cross-sectional view of the plate gripping and securing device 20 is illustrated. A portion of a plate cylinder 22 is shown of the type used in rotary offset printing presses. In general, cylinder 22 may be a plate cylinder or a blanket cylinder, for example, of any of the various types of rotary printing presses. The overall structure of the cylinder 22 and the rotary printing press (not shown) are well known in the art and thus are not described in detail herein.

Cylinder 22 is provided with a bore 24 that extends in parallelism with the rotational axis (not shown) of cylinder 22. Shaft 10 is sized to rotatably fit within bore 24 with adequate clearance to accommodate tines 12 extending from the shaft. Shaft 10 is in longitudinal alignment with bore 24 and radially offset such that the surface of shaft 10 opposite the tips 18 of tines 12 is in contact with a portion 25 of the curved surface of bore 24, which provides support and prevents warping and deflection of shaft 10 when in the plate-securing position.

A narrow channel 26 is provided in cylinder 22 extending generally axially and radially inwardly in cylinder 22 from the outer surface 28 of the cylinder. Channel 26 is generally rectangular in cross-section and extends parallel to bore 24. The inner end of channel 26 is in tangential communication with bore 24 forming a chord with respect to bore 24. The width of channel 26 is preferably slightly more than twice the thickness of plate 30. Plate 30 may be made of polyester or plastic or other flexible material which is typically approximately 0.008 inches thick.

Each tine 12 is adjusted so that the separation 36 between the lateral wall 38 of channel 26 and the tip 18 of tine 12 is approximately 0.008 inch when tine 12 is generally axially perpendicular to lateral wall 38. Separation 36 may vary by +/− one half the thickness of the plate 30. Thus, for example, for a plate thickness of 0.008 inch, tines 12 may be adjusted such that the separation 36 between lateral wall 38 and tip 18 is between 0.004 inch and 0.012 inch. Preferably, the separation 36 is equal to the thickness of plate 30.

Operation

In operation, tines 12 are adjusted by turning the tines with a hex wrench inserted into tail socket 16 through threaded bore 14 in shaft 10. For a thirty-six inch cylinder, there may be eight to twenty tines spaced along shaft 10. Preferably, all tines 12 generally extend equally from shaft 10.

Shaft 10 is inserted into bore 24 and conventionally and rotatably secured in place in a plate-releasing position as illustrated in FIG. 5. Plate 30 has a leading leg 32 and a trailing leg 34 which may be angled or beveled. Plate 30 is mounted on cylinder 22 by placing the leading leg 32 of plate 30 into channel 26 of cylinder 22 and wrapping the plate around the surface 28 of cylinder 22 until the trailing leg 34 can be inserted into channel 26.

Trailing leg 34 is inserted into channel 26 and shaft 10 is rotated counter-clockwise to the plate-locking position as illustrated in FIG. 6. As shaft 10 is rotated, typically by applying a wrench to head 11 of shaft 10, the tip 18 of tine 12 contacts the surface of trailing leg 34. As shaft 10 continues to rotate in the counter-clockwise direction, tip 18 penetrates through trailing leg 34 and pulls trailing leg 34 into channel 26 and plate 30 into contact with cylinder surface 28. When tine 12 is generally axially perpendicular to lateral wall 38, preferably the tip 18 has penetrated trailing leg 34 and is compressing or has slightly penetrated the surface of leading leg 32 without moving leading leg 32. The shape of tip 18 allows tine 12 to grip the trailing leg 34 of plate 30 without slicing or tearing it. Additionally, the shape of nose 17 forces trailing leg 34 into leading leg 32 securing the plate 30 to the surface 28 of cylinder 22.

To release plate 30, shaft 10 is rotated clockwise to the plate-releasing position shown in FIG. 5. The clockwise rotation ejects trailing leg 34 from channel 36.

Having thus described the invention, what is claimed as new and desired to be secured by Letters Patent is as follows:

1. In a rotary printing press having a rotatable cylinder provided with a channel therein extending in general parallelism with an axis of rotation of the cylinder and directed generally radially into the cylinder from an outer surface thereof, wherein the channel is adapted to receive a leading leg and a trailing leg of a flexible plate, a device for securing the plate on the cylinder comprising:

a bore in said cylinder extending in general parallelism with the axis of rotation thereof and communicating with said channel, an operating shaft rotatably positioned in said bore for rotation between a plate-securing position and a plate-releasing position, a plurality of tines spaced axially along and extending generally radially outwardly from said shaft and each tine having a generally conically shaped nose provided with a generally flat tip, each of said tines penetrating said trailing leg of said plate to releasably grip said trailing leg and secure said plate in said channel upon rotation of said shaft to said plate-securing position, said channel having a wall facing said bore, and said tines compressing said leading leg of said flexible plate against said wall upon rotation of said shaft to said plate-securing position.

2. The device as claimed in claim 1 wherein said tines eject said trailing leg of said flexible plate from said channel upon rotation of said shaft to said plate-releasing position.

3. The device as claimed in claim 1 wherein said shaft contacts a portion of said bore opposite said channel upon rotation of said shaft to said plate-securing position.

4. The device as claimed in claim 1 wherein said flexible plate is aluminum.

5. The device as claimed in claim 1 wherein said flexible plate is polyester.

6. The device as claimed in claim 1 wherein said flexible plate is plastic.

7. The device as claimed in claim 1 wherein each of said tines has a plate-engaging tip spaced from said channel wall when said shaft is in said plate-securing position and each presenting a gap.

8. The device as claimed in claim 7 wherein each of said gaps is approximately the thickness of said leading leg of said flexible plate.

9. The device as claimed in claim 7 wherein each of said gaps is approximately 0.008 inch.

10. A device for securing a flexible plate on a rotatable cylinder of a rotary printing press comprising:

a channel extending in general parallelism with an axis of rotation of said cylinder and directed generally radially into said cylinder from an outer surface thereof, said channel presenting an internal wall and adapted to receive a leading leg and a trailing leg of said flexible plate, said cylinder having a bore therein extending in general parallelism with said axis of rotation and communicating with said channel opposite said wall, an operating shaft rotatably positioned in said bore for rotation between a plate-securing position and a plate-releasing position, said shaft contacting a portion of said bore opposite said channel upon rotation of said shaft to said plate-securing position, and a plurality of tines spaced axially along and extending generally radially outwardly from said shaft and each tine having a generally conically shaped nose provided with a generally flat tip, each of said tines penetrating said trailing leg of said plate to releasably grip said trailing leg and secure said plate in said channel upon rotation of said shaft to said plate-securing position, and said tips of said tines compressing said leading leg of said flexible plate against said wall upon rotation of said shaft to said plate-securing position.

11. The device as claimed in claim 10 wherein said tines eject said trailing leg of said flexible plate from said channel upon rotation of said shaft to said plate-releasing position.

12. The device as claimed in claim 10 wherein the tip of each of said tines is spaced from said channel wall when said shaft is in said plate-securing position and each presenting a gap.

13. The device as claimed in claim 12 wherein each of said gaps is approximately the thickness of said leading leg of said flexible plate.

14. The device as claimed in claim 12 wherein each of said gaps is approximately 0.008 inch.

15. The device as claimed in claim 12 wherein each of said tines is moveable in directions radially of said cylinder to set each tip at a predetermined spacing from said channel wall.

16. The device as claimed in claim 10 wherein said flexible plate is aluminum.

17. The device as claimed in claim 10 wherein said flexible plate is plastic.

* * * * *